United States Patent [19]

Shaw et al.

[11] 4,338,874

[45] Jul. 13, 1982

[54] INERT GAS SUPPLY AND SALVAGE SYSTEM FOR OIL TANKERS

[75] Inventors: Peter V. Shaw, London; Stewart Speed, Bromley, both of England

[73] Assignee: The British Petroleum Company Limited, London, England

[21] Appl. No.: 115,341

[22] Filed: Jan. 25, 1980

[30] Foreign Application Priority Data

Feb. 17, 1979 [GB] United Kingdom ..... 7905651

[51] Int. Cl.[3] ..... B63C 7/12

[52] U.S. Cl. ..... 114/50

[58] Field of Search ..... 114/52, 74 R, 125, 50, 114/44

[56] References Cited

U.S. PATENT DOCUMENTS 2,363,488 11/1944 Bartlett ..... 114/50
3,307,512 3/1967 Fell ..... 114/74 R
3,745,960 7/1973 Devine ..... 114/74 R
4,144,829 3/1979 Conway ..... 114/74 R
4,233,922 11/1980 Conway ..... 114/74 R

*Primary Examiner*—Ralph J. Hill
*Attorney, Agent, or Firm*—Morgan, Finnegan, Pine, Foley & Lee

[57] ABSTRACT

An inert gas supply system suitable for salvaging a damaged oil tanker comprises an inert gas generator (1), a pressurizing blower (5), piping (3, 12), at least one combined purge pipe, pressure indicator and pressure vacuum release device (4) and at least one set of seals and isolating tanks.

The system may be used for reducing hydrocarbon gas accumulations on a damaged tanker to safe levels, pressurizing damaged tanks to improve buoyancy, and maintaining non-flammable atmospheres during off-loading of cargo or discharge of ballast.

5 Claims, 5 Drawing Figures

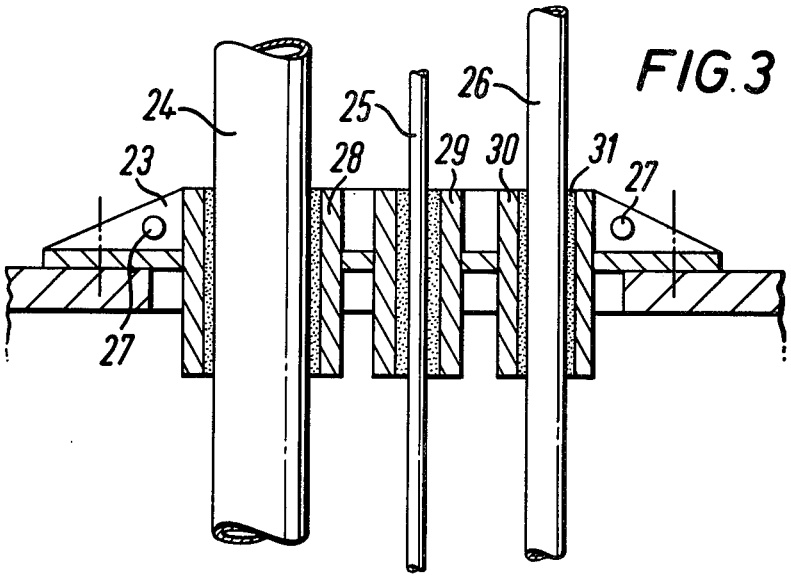
FIG.3
FIG.4
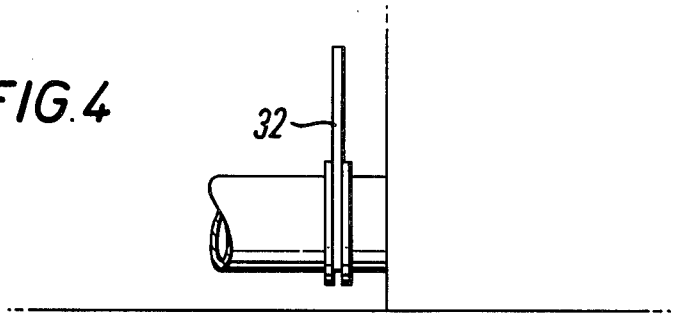
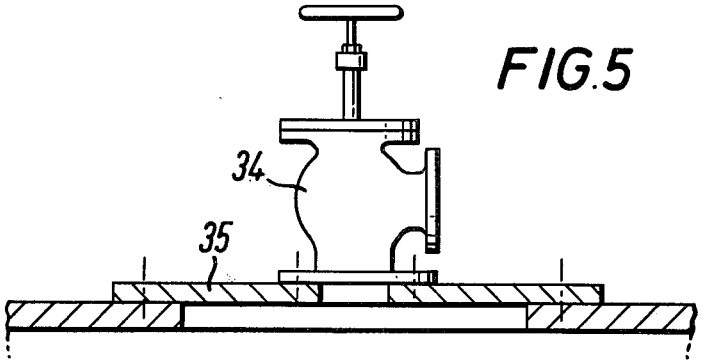
FIG.5

INERT GAS SUPPLY AND SALVAGE SYSTEM FOR OIL TANKERS

This application relates to an inert gas supply system for oil tankers, and, in particular, to a portable inert gas supply system for use on damaged oil tankers.

It is becoming a common practice for oil tankers to have inert gas systems which provide the means by which explosive atmospheres in the cargo tank spaces are eliminated. If a tanker is damaged by collision or grounding however, the inert gas system may be put out of action and the more serious the damage the more likely is this to happen. Nevertheless, if the atmosphere in the vessel's cargo tanks is to be rendered safe and the vessel salvaged a supply of gas under pressure may be essential to:

(a) displace water from breached tanks and other areas and so increase buoyancy, (b) maintain cargo tank atmospheres in a non-flammable condition for the discharge of cargo and/or water from intact tanks.

In a recent tanker accident, it was necessary to air lift a portable air compressor to the tanker so that water could be displaced by compressed air and buoyancy increased. However, the fact that the gas was air and not an inert gas, meant that the salvage operation was carried out with explosive (or a high probability of explosive) atmospheres developing in the cargo tanks, because the breached tanks still contained hydrocarbon vapours and there were generally accumulations of hydrocarbon vapours in and around the vessel.

The desirability of having a portable source of inert gas for use in salvaging damaged tankers is, therefore, evident. Portable inert gas generators do, in fact, exist, but a complete portable system for use on damaged tankers requires additional items if it is to function efficiently and effectively.

The present invention is therefore concerned with a complete, portable inert gas system.

According to the present invention a portable, inert gas system suitable for use on damaged oil tankers comprises:

an inert gas generator and ancillary equipment a pressurising blower for the inert gas generated piping for transferring the inert gas to the area required at least one combined purge pipe, pressure indicator and pressure vacuum release device capable of being fitted to an existing opening in a tank, and at least one set of seals capable of sealing an existing opening in a tank and isolating the tank from other tanks and from atmosphere.

As previously indicated portable inert gas generators are known. Preferably the generator is of a size such that it can be air-lifted by helicopter. By "ancillary equipment" is meant all the equipment necessary to provide inert gas ready for direct use. Thus the ancillary equipment may include:

a tank and pumps for supplying fuel to the generator a power source, e.g. a diesel engine, and means for converting power to alternative forms, e.g. an alternator for converting mechanical to electrical power means for cooling the inert gas generated.

The inert gas generated may be passed to an accumulator for the inert gas, e.g. a relatively large diameter gas main with a pressure gauge and safety pressure release valve, which absorbs any pressure fluctuations in the system.

The accumulator may have a number of take off points for relatively small diameter, lightweight piping for distributing the inert gas to the areas of the damaged tanker where it is required. A pressurising blower may be inserted into these distribution lines as necessary to increase the pressure to any selected value up to the maximum capability of the blower (e.g. up to about 0.7 bars gauge) when the inert gas is required to expel water from damaged tanks. The pressurising blower may be driven by any suitable means, e.g. by a separate diesel engine and alternator or by power supplied from the ancillary equipment of the inert gas generator.

As will be discussed in more detail, hereafter, the inert gas may be used for a number of operations in the salvaging of a damaged tanker, e.g.

(a) reducing to safe proportions, the percentage of hydrocarbon gas and oxygen in the cargo tanks of the vessel, and any other compartments which have become dangerously contaminated by cargo leakage, e.g. pumproom, (b) pressurising damaged tanks to displace ingressed water and improve the vessel's buoyancy, (c) to maintain tank atmospheres in a non-flammable condition when off-loading cargo or discharging ballast water.

A particular feature of the present invention is thus the provision of equipment which can be used for all three operations.

One of the pieces of such equipment is a combined purge pipe, pressure indicator, and pressure vacuum release. The pipe comprises means for attaching the pipe to an existing opening of a tank, a vent to atmosphere, preferably a high velocity vent, a manometer and a three way cock so that the interior of the tank may be either connected to the vent or connected to the manometer. The vent may be detachable so that it can be replaced, for certain operations, by a pressure relief valve.

Other pieces of such equipment are seals for isolating tanks from each other and from atmosphere while, if necessary, allowing salvage pumps and their associated piping and equipment to be put into the tanks. One type of seal may thus be a seal for the cargo vent line of a tank. Another type of seal may be a seal for a tank cleaning opening, this seal having provision for passing one or more pipes through it.

The equipment of the system may be designed in light, easily transportable modules, the number of modules required for any one salvage operation being dictated by:

the nature and extent of the damage size of the vessel whether or not the vessel is fitted with an inert gas system and, if so, its operational capability.

The system is preferably completely independent of the vessel's power supply and water services.

The present invention includes a method of salvaging a damaged oil tanker using a portable inert gas system as herein described, said salvaging involving one or more of the operations (a), (b) or (c) previously described.

The invention is illustrated with reference to the accompanying drawings in which FIG. 1 is a diagram of an inert gas system according to the present invention.

FIG. 3 is a diagram of a seal provided at a tank cleaning opening on deck.

FIG. 4 is a diagram showing a blanking arrangement for a tank vent line, and

FIG. 5 is an inert gas inlet pipe connection at a tank cleaning opening.

Figure 1:
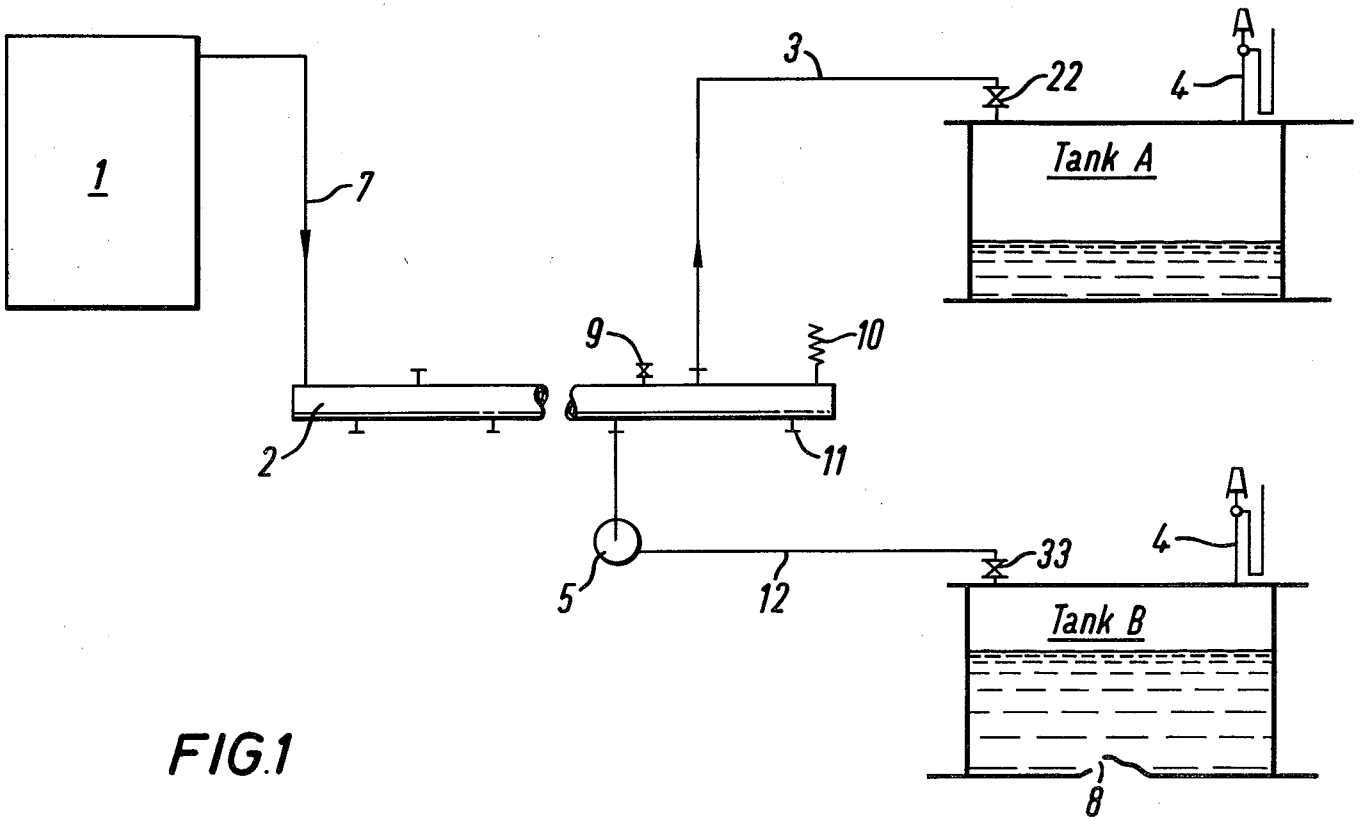

In FIG. 1 a portable inert gas generator is indicated at 1. The generator includes all the ancillary equipment for producing cool, inert gas into line 7. A suitable generator may be one producing inert gas at 0.15 bar pressure at a rate of 1300 $m^3$/hour and with delivery speeds of 12 to 54 m/sec depending on the outlet pipe diameter.

Line 7 feeds the gas to the gas main and pressure accumulator 2. Accumulator 2 may be a pipe built up from standard lengths, the overall length required being dependent in each case on operational requirements; e.g. the extent of gas distribution envisaged, and the size of vessel. The pipe may be manufactured from glass reinforced plastic (GRP) and may be specially treated to reduce electrostatic charge build up. It has a pressure gauge connection 9, a pressure release valve 10, and a number of distribution points 11 to which small diameter, flexible piping can be attached. Two such pipes are shown at 3 and 12, pipe 12 having a pressurising blower 5 therein. Blower 5 is driven by a totally enclosed gas tight electric motor. The power supply for this motor may be obtained from the diesel alternator.

By way of illustration only, pipe 3 leads to an intact tank A of a damaged oil tanker and pipe 12 to a damaged tank B. The pipes are connected to the tanks through one of the existing tank entry points, e.g. a tank cleaning opening on the deck of the tanker. Adaptors fitted with isolating valves 22, 33 may be fitted to these openings to provide connection points for the gas distribution branch pipes. Connected to another tank entry point of each tank (e.g. another tank cleaning opening) is a combined purge pipe, pressure indicator and pressure vacuum release 4, described in more detail in FIG. 2.

Figure 2:
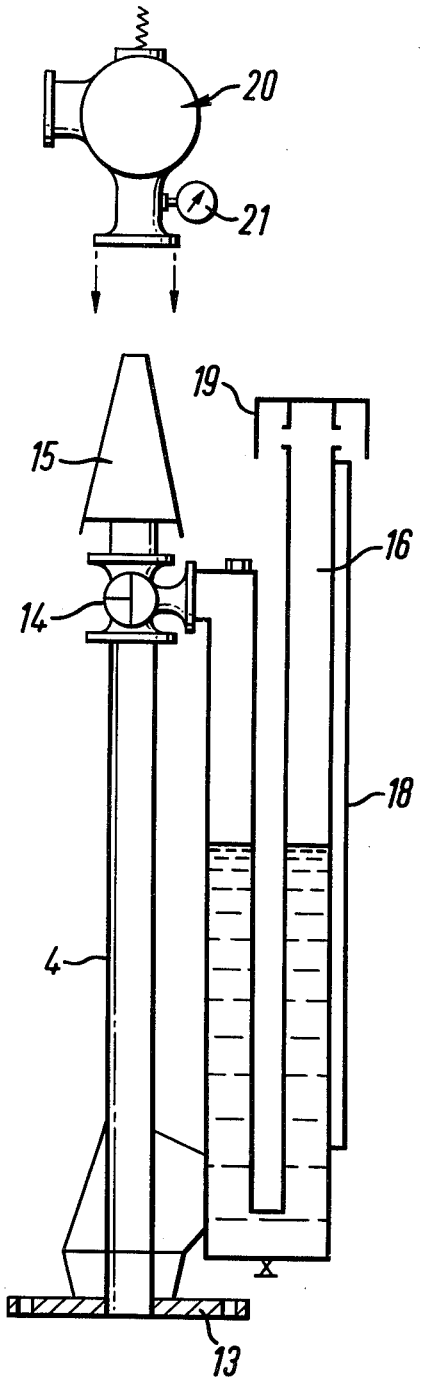
FIG. 2 is a section through a diagrammatic arrangement of a combined purge pipe, pressure indicator and pressure vacuum release.

In FIG. 2 the purge pipe 4, which may be formed on GRP, has a plate 13 to connect it to a tank cleaning opening. At the top of pipe 4 is a three way cock 14. The three positions of the cock either connect it to atmosphere via a high velocity vent head 15 or connect it to a manometer and pressure vacuum release 16. The manometer consists of a U-tube partly filled with liquid (e.g. water) and has a pressure scale 18. The end of the U-tube not connected to valve 14 is open to atmosphere through a cowl 19. For certain uses, described in more detail hereafter, the high velocity vent head may be detached and replaced by a pressure relief valve 20, which can be pre-set to a given pressure, and which has a pressure gauge 21.

FIG. 3 shows a seal for fitting to a tank cleaning opening when it is necessary to place a pump within a tank. In FIG. 3 the seal 23 may be manufactured from aluminium alloy and may be made in two pieces which clamp around a pump discharge hose 24, lifting rope 25, and hydraulic hose 26 after the pump has been lowered into the tank. The seal 23 may bolt down on the existing tank cleaning cover securing studs thus providing a gas tight seal with the opening. The two pieces of the seal may be held together by clamp bolts 27. The two pieces of the seal may have semi-cylindrical guides 28, 29, 30 which form cylinders around the pump discharge hose, lifting rope and power supply hose when the pieces are clamped together and which may contain soft packing 31 to provide a seal.

Tank vent lines may be sealed by inserting a space blank 32 in the line as shown in FIG. 4. The material used in manufacturing the blank may be Tufnol with bonded rubber joints.

FIG. 5 shows, in more detail, an isolating valve (22 and 33 of FIG. 1) to which the inert gas distribution lines (3 and 12 of FIG. 2) may be connected. The valve may be a screw lift valve 34 fitted to an existing tank cleaning opening cover plate 35 which has been modified by boring out.

In use one or more modules containing generator 1, accumulator 2, pipes 3 and 12, purge pipes 4, pump 5, isolating valves 22 and 33, seals 23, and tank gas vent line blanks 32 may be air lifted to a damaged tanker. The number of pipes, purge pipes and seals per module may be varied depending on the requirements. The pipes 3, 12 and purge pipes 4 are fitted to the required tanks and set by the three way cock 14 so that the pressure measuring and pressure vacuum release device is in operation.

Tank A is an intact tank containing oil cargo or ballast water but with an accumulation of hydrocarbon vapours in its ullage space. Such vapours could mix with those of other tanks when common cargo vent lines are fitted.

In order to inert the atmosphere in tank A, the following operation is carried out.

The cargo vent line is sealed with a spade blank 32.

The purge pipe 4 is set to its purging mode; i.e. open to the atmosphere through the high velocity head 15.

The tank is connected to the inert gas main 2 by distribution line 3 and the valve 22 on the distribution line adaptor opened.

The inert gas generator is started and inert gas is supplied to the tank at a velocity of between 12 and 54 m/sec. This induces simultaneous purging of hydrocarbons and inerting, by the mixing process.

In a tank containing oil, regeneration of hydrocarbons will take place. Therefore, the purging and inerting process is monitored on oxygen content of the tank atmosphere only. When the oxygen content of the gases leaving the purge pipe is below 8% by volume the operation is complete.

The purge pipe changeover cock is set to connect the tank to the manometer and pressure vacuum release, the gas inlet valve to the tank closed, and the generator stopped.

Tank B is a damaged tank containing water which has entered through the damaged portion 8. It may nevertheless contain a potentially explosive mixture of hydrocarbon vapours and oxygen and, if so, it may be inerted in the manner described for intact tank A. In any case it is sealed and isolated from other tanks as described for tank A.

To recover buoyancy in tank B, water is displaced by supplying inert gas under pressure to the ullage space; i.e. space above the liquid level. The amount of buoyancy gained is equal to the weight of water displaced which in turn is proportional to the gas pressure applied. The maximum pressure which can be applied is dependent on the design and strength of the structure.

To pressurise the tank the following procedure is adopted.

The relief valve 20 is fitted to the purge pipe 4 in place of the high velocity head 15.

The maximum safe pressure which can be applied to the tank is calculated and relief valve 20 set to that pressure.

The three way cock is adjusted to isolate the pressure measuring and pressure vacuum release 16 and connect the tank to the relief valve 20.

The booster blower 5 is connected to the distribution line 12 and the line connected to the gas main and the tank.

The gas generator and booster blower are then started and the tank pressure raised to just below the maximum allowable pressure as calculated above. The tank pressure is clearly indicated on the pressure gauge 21.

When the desired pressure is reached the gas inlet valve 33 is closed and the booster blower and inert gas generator switched off.

Intact tanks can be emptied of oil cargo or ballast water once the tank has been correctly inerted as previously described for tank A. During the pumping operation inert gas is supplied to the tank to replace the volume of cargo discharged. It is essential that the pressure vacuum release device is connected to the tank by cock 14. If the vessel's pumping machinery is still functioning this presents no problem, but in most cases involving severe damage this is unlikely. Portable pumps have therefore to be lowered into and used inside the tanks. These portable pumps have a drive hose and a discharge hose which have to pass through a tank opening. It may be necessary to move the pump up and down within the tank as the liquid level alters so the hoses similarly have to be free to move. The seal described in FIG. 3 is used in this operation, preventing inert gas escaping from the tank but allowing the pump discharge hose and pump drive hose to pass through freely as the pump is raised or lowered to cater for changes in the liquid level. Insert gas is supplied through a pipe similar to pipe 3 throughout the pumping operation to ensure a positive pressure exists in the tank at all times.

A purge pipe 4 is also positioned on the tank as described for tank A with the three way cock 14 open to the manometer. The purge pipe 4 and manometer provide a pressure indication and also act as a safety device if the pressure exceeds or drops below set values.

We claim:

1. A method for salvaging an oil tanker comprising:

purging combustible gasses from a compartment of said tanker;

regulating the back pressure of purged gasses;

connecting, via a covering plate, a source of inert gas to a first opening of said compartment;

forcing said inert gas into said compartment via said first opening with a pressure equal to or greater than said back pressure to insure complete purging of said combustible gasses;

lowering a pump and pump driving and discharge hoses via a lift cable through a second opening into said compartment; and slidably sealing said lift cable and said pump hoses to said second opening for containment of said gasses while pumping liquid via said pump discharge hose from said compartment.

2. A salvage system for an oil tanker comprising:

a source of inert gas;

means for connecting said source of inert gas to a compartment of said tanker, said source including means for pressurizing said gas sufficiently for driving out liquid from said tank;

means for pumping liquid from a compartment of said tanker, said pumping means including hose for the withdrawal of liquid and cabling for lowering said pumping means into said compartment via an opening in said compartment;

a seal for closing off said opening about said hose and said cabling, said seal being formed of two sectors mating at semi-cylindrical guides for admission of said hose and said cabling; and vapor purging means adapted to be coupled to an opening of said compartment, and having a direct vent and a manometer vent for alternative venting of entrapped gas from said compartment.

3. A system according to claim 2 wherein said seal is adapted to be secured to cover mounting studs of said opening for admission of said pumping means.

4. A system according to claim 2 wherein said purging means includes a three-way cock coupling said direct and said manometer vents to said compartment.

5. A system according to claim 4 where said purging means includes means for alternatively coupling a pressure regular to said cock, and wherein said compartment is a tank.

* * * * *